United States Patent [19]

Baker, Jr.

[11] 4,047,595

[45] Sept. 13, 1977

[54] HYDRAULIC-POWERED DEVICE

[75] Inventor: Glen O. Baker, Jr., Kent, Wash.

[73] Assignee: Ingersoll-Rand Company, Woodcliff Lake, N.J.

[21] Appl. No.: 615,409

[22] Filed: Sept. 22, 1975

[51] Int. Cl.[2] ..... F01M 9/00

[52] U.S. Cl. ..... 184/6.14; 91/235

[58] Field of Search ..... 184/6.14

[56] References Cited

U.S. PATENT DOCUMENTS

| | | | |
|---|---|---|---|
| 1,152,398 | 9/1915 | Corey | 184/6.14 |
| 2,457,893 | 1/1949 | Hlinsky | 184/6.14 |
| 2,682,203 | 6/1954 | Senn | 184/6.14 |
| 3,737,008 | 6/1973 | Walker | 184/6.14 |

*Primary Examiner*—Verlin R. Pendegrass
*Assistant Examiner*—Thomas H. Webb
*Attorney, Agent, or Firm*—Bernard J. Murphy

[57] ABSTRACT

In a first embodiment an improved, hydraulic-powered paving breaker is depicted in which a novel arrangement is provided for internally lubricating the breaker. In the arrangement an elbow taps off discharging pressured hydraulic fluid from the breaker and, through a manifold line coupled to fittings, which are in penetration of the housing of the breaker, admits hydraulic fluid into the breaker to lubricate a reciprocating plunger, moil, and O-ring seals. In an alternative embodiment, a conduit is formed entirely within the breaker for the same purpose. In both embodiments a restrictor device is interposed between the supply of pressured hydraulic fluid and the points of fluid injection to insure a uniform supply of fluid to the latter at a given prescribed pressure.

6 Claims, 3 Drawing Figures

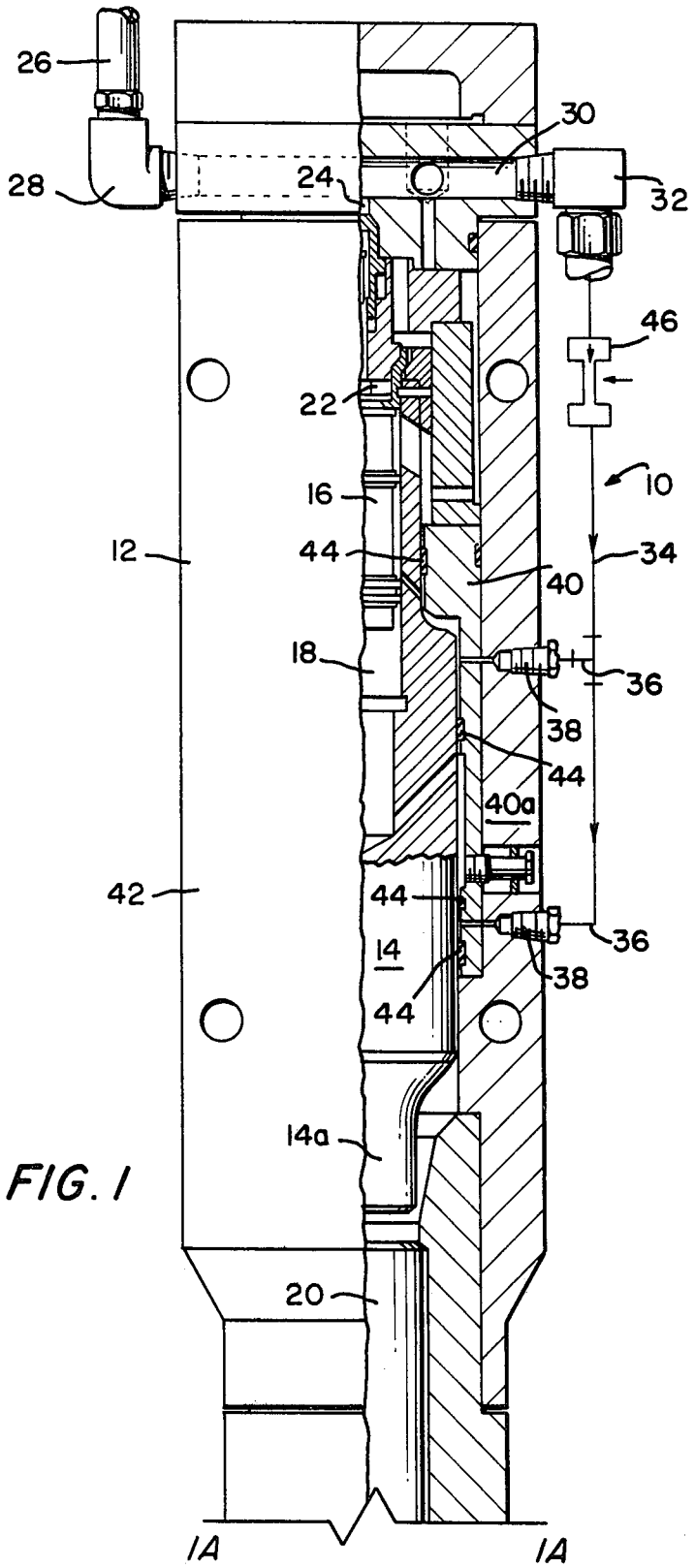
FIG. 1
FIG. 2
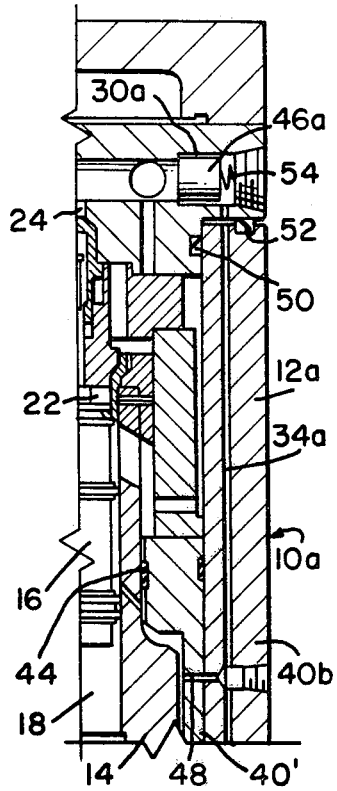
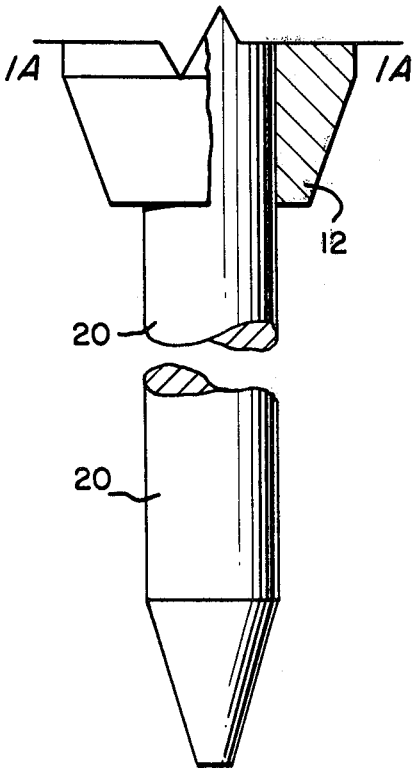
FIG. 1A

HYDRAULIC-POWERED DEVICE

This invention pertains to hydraulic-powered devices and apparatus, and in particular to means for lubricating such devices and apparatus internally.

In prior art devices which are hydraulically operated, it is not unknown to arrange a lubrication system which efficiently introduces lubrication oil thereinto to lubricate reciprocating or other moving parts. However, it is customary to use a fluid, to wit: lubricating oil, which is other than and distinct from the hydraulic fluid employed to operate the device. Accordingly, two separate sources of fluid supply need to be provided and accomodated for, in this practice. It is an object of this invention to teach the improvement and simplification of employing a portion of the very same hydraulic fluid, which enables operation of the subject device, as a lubricant for the device.

It is particularly an object of this invention to set forth an improved, hydraulic-powered device, such as an impact ram and the like, having internal components which, during operation of the device, exhibit a relative, slidable interface therebetween, the device being operative in response to power supplied by hydraulic fluid under pressure, the device further having first means for admitting pressured, powering hydraulic fluid thereinto to operate same, and having second means for discharging spent hydraulic fluid therefrom, wherein the improvement comprises: conduit means, in fluid-flow communication with one of said first and second means, for tapping off a quantity of supplied hydraulic fluid; and means opening internally of the device, and in fluid-flow communication with said conduit means, for introducing tapped-off hydraulic fluid internally of the device for lubricating the slidably-interfacing components.

Further objects of this invention, as well as the novel features thereof, will become more apparent by reference to the following description taken in conjunction with the accompanying figures in which:

FIG. 1 is an axial and partly cross-sectional view of a hydraulically-powered paving breaker which, only by way of example, is depicted to show, in a first embodiment, a means of lubricating the breaker;

FIG. 1A is a discontinuous portion of FIG. 1 showing the remainder of the working end of the breaker together with the moil which also benefits from the lubricating means; and FIG. 2 depicts a fragmentary cross-sectional view of a paving breaker substantially identical to that of FIG. 1 except that, in this embodiment, the lubricating means is wholly confined within the breaker itself.

As shown in FIGS. 1 and 1A, a first embodiment of the improved hydraulic-powered device incorporating a novel lubricating means 10 is shown in connection with a paving breaker 12. The paving breaker here depicted is more fully disclosed, as to its structure and mode of operation, in U.S. Pat. No. 3,822,633, "Control Means for a Fluid-Powered Device," issued on July 9, 1974, to Jack B. Ottestad. It will suffice for the purpose of this disclosure to explain that the device here depicted comprises a paving breaker 12 which has a reciprocating plunger 14, the latter confining therewithin a reciprocating piston 16 which is biased, by means of a gas confined within a piston chamber 18 formed in the plunger. The plunger 14 repeatedly cycles, in a reciprocating fashion, to work like a hammer on the moil 20 shown in FIGS. 1 and 1A.

Hydraulic fluid under high pressure is admitted to a charging chamber 22 in the head of the paving breaker 12 (by means not shown here). In addition, the spent, hydraulic fluid is discharged from the paving breaker, and from a venting chamber 24 in the head of the breaker, by means of a conduit 26 which is coupled to the chamber 24 through an elbow 28. As depicted in the aforementioned patent, the chamber 24 is open to the elbow 28 and conduit 26 at only one side. However, for the practice of the present invention, an access 30 is bored into the head of the breaker and tapped to receive a second elbow 32 through which some of the spent or discharging hydraulic fluid may be drawn off. To the elbow 32 is connected a manifold line 34 from which a plurality of taps 36 are taken. Accordingly, hydraulic fluid is supplied therethrough and, via injectors 38, through the walls 40, 40*a* of the housing 42 to lubricate the plunger 14 where the latter defines a slidable interface with the inner surfaces of the housing.

With the reciprocation of the plunger 14 the injected hydraulic fluid migrates and insinuates itself around and past seals 44 arranged between the plunger 14 and the inner housing surfaces. So also, with reciprocation of the plunger, and due to the pressure of the hydraulic fluid being injected, portions of the fluid migrates to the working end 14*a* of the plunger to provide lubrication of the moil 20 and the housing end in which it is slidably mounted.

According to the embodiment of the paving breaker here depicted, the venting or discharging hydraulic fluid is nominally at a pressure of approximately 100 p.s.i. Too, this discharging fluid is constantly undergoing surge (due to the cyclic action of the breaker). Now, for the purposes of lubrication, it is not necessary that the pressure of injected hydraulic fluid "lubricant" be at 100 p.s.i. Therefore, to insure a steady, non-surging flow of hydraulic fluid lubricant at some pressure less than 100 p.s.i., a restrictor device 46 is interposed in the manifold line 34 intermediate the elbow 32 and the injectors 38.

I have shown in a first embodiment of the invention means for lubricating a breaker 10 with a second elbow 32 tapped into the hydraulic fluid venting chamber 24. Of course, it is well within the ambit of the invention to dispense with the elbow 32 and access 30, and employ a pipe Tee (in lieu of elbow 28) in conjunction with the discharge conduit 26. By this means then it will be necessary to make no further intrusion into the hydraulic fluid venting chamber 24.

In the alternate embodiment of the invention shown in FIG. 2, the novel lubricating means 10*a* are wholly contained within the breaker 12*a*; there are no external exposed components which might be subject to damage. In this embodiment a conduit 34*a* is formed axially within the outer shell or wall 40*b* of the device, the same opening onto a plurality of injection holes 48 (only one of which is shown). A first radial O-ring 50 and a second axial O-ring 52 cooperate to insure that the hydraulic fluid supplied will be confined to the conduit 34*a*. In this embodiment a restrictor device 46*a* is confined, and restrained therein by means of a spring 54, within an enlarged recess formed within the access 30*a* in the head of the breaker 10*a*.

While I have described my invention in connection with specific embodiments thereof it is to be clearly understood that this is done only by way of example and not as a limitation to the scope of my invention as set forth in the objects thereof and in the appended claims.

I claim:

1. An improved, hydraulic-powered device, such as an impact ram and the like, having internal components which, during operation of the device, exhibit a relative, slidable interface therebetween, the device being operative in response to power supplied by hydraulic fluid under pressure, the device further having first means for admitting pressured, powering hydraulic fluid thereinto to operate same, and having second means for discharging spent hydraulic fluid therefrom, wherein the improvement comprises:

conduit means, in fluid-flow communication with one of said first and second means, for tapping off a quantity of supplied hydraulic fluid; and means opening internally of the device, and in fluid-flow communication with said conduit means, for introducing tapped-off hydraulic fluid internally of the device for lubricating the slidably-interfacing components.

2. An improved, hydraulic-powered device, according to claim 1, further including:

means interposed in said conduit means for controlling flow of hydraulic fluid to said internally-opening lubricating means.

3. An improved, hydraulic-powered device, according to claim 2, wherein:

said controlling means comprises a restrictor means for maintaining a uniform pressure and flow of hydraulic fluid to said lubricating means.

4. An improved, hydraulic-powered device, according to claim 1, wherein:

said conduit means is formed internally of the device.

5. An improved, hydraulic device, according to claim 1, wherein:

said conduit means is carried externally of the device.

6. An improved, hydraulic device, according to claim 5, wherein:

said internally-opening lubricating means comprises lubricant fitting means replaceably inserted through an external wall of the device.

* * * * *